United States Patent [19]

Buehler et al.

[11] 3,961,492

[45] June 8, 1976

[54] MACHINE FOR AND METHOD OF STEMMING BLAST HOLES

[75] Inventors: Jay K. Buehler; Thomas R. Carlson, both of Salt Lake City; Alvin J. McIntosh, Midvale, all of Utah

[73] Assignee: Kennecott Copper Corporation, New York City, N.Y.

[22] Filed: Feb. 7, 1975

[21] Appl. No.: 548,029

[52] U.S. Cl. ..... 61/63; 61/35; 37/118 R; 172/253

[51] Int. Cl.[2] ..... E02D 29/12; E02B 1/00; A01B 63/00

[58] Field of Search ..... 61/35, 63; 37/118; 172/253, 802; 214/140, 651

[56] References Cited

UNITED STATES PATENTS

| | | | |
|---|---|---|---|
| 2,556,592 | 6/1951 | Markkula | 37/118 R |
| 3,198,568 | 8/1965 | Mindrm | 214/651 X |

*Primary Examiner*—Jacob Shapiro
*Attorney, Agent, or Firm*—Mallinckrodt & Mallinckrodt

[57] ABSTRACT

In accordance with the invention, the stemming of blast holes, i.e. the covering (with peviously removed earth materials) of explosive charges placed in receiving boreholes drilled downwardly from generally horizontal surfaces in open-pit mines, involves the proper manipulation of a special vehicle relative to earth material cuttings that collect concentrically about the mouth of such a borehole during the drilling operaton. The vehicle carries a combination of earth-moving blades that can be raised and lowered as a unit and that comprises a transverse pusher blade mounted on one end of the vehicle and a pair of elongate auxiliary blades pivotaly mounted on and in mutually spaced relationship transversely of the pusher blade as arms which can be swung toward and away from each other. The auxiliary blades have respective tip portions turned toward each other, and are preferably arranged to stop short of meeting when swung together so as to accommodate the blast cord between such tip portions. In carrying out the method, the vehicle with auxiliary blades extended outwardly is moved directly toward and to the hole, so the pusher blade will engage and push drill cuttings into the hole from the front; the auxiliary blades are then swung together for pushing drill cuttings into the hole from its opposite sides; and then, without retracting the auxiliary blades, the vehicle is backed away from the hole, so the tip portions of the auxiliary blades will pull drill cuttings into the hole from the rear.

7 Claims, 5 Drawing Figures

FIG. 1
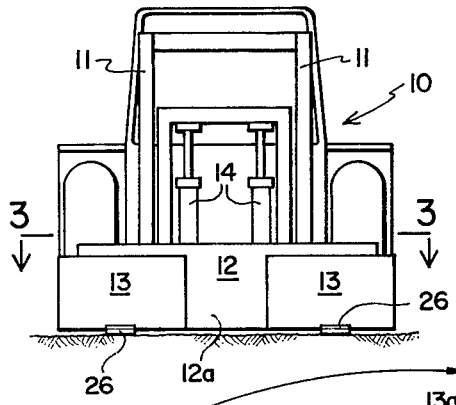
FIG. 2
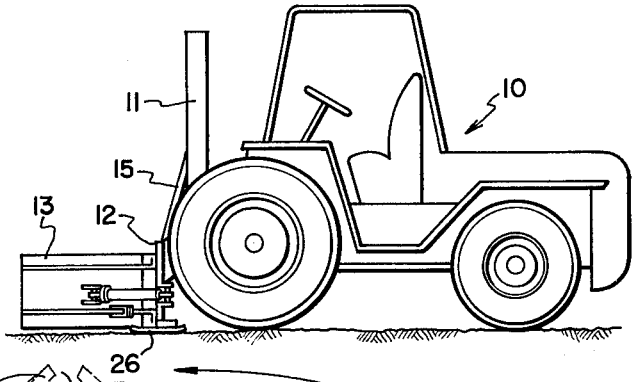
FIG. 3
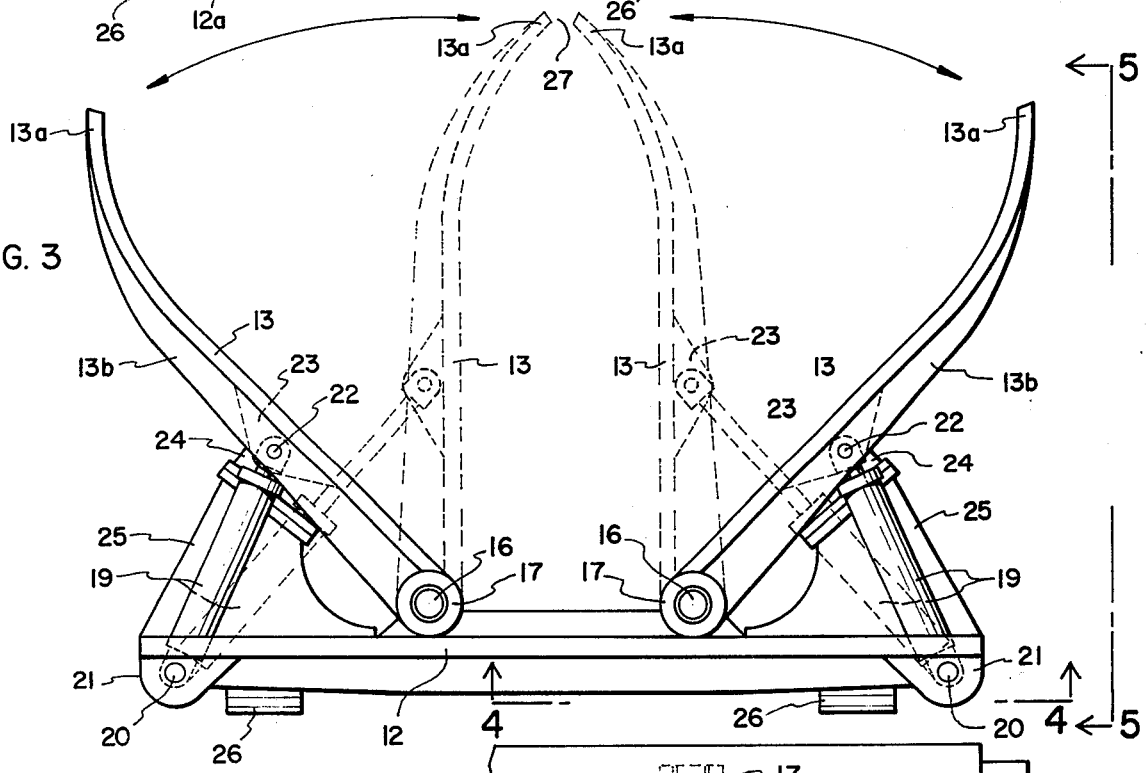
FIG. 4
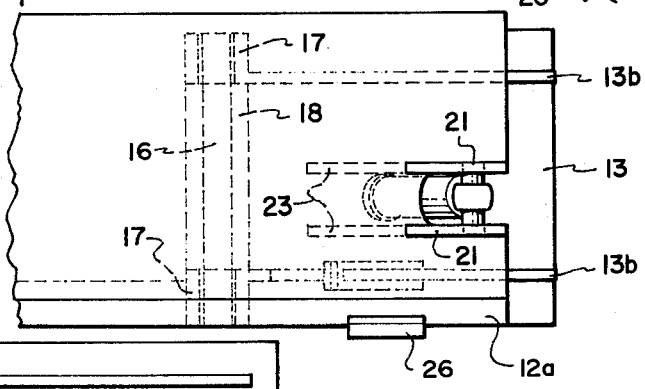
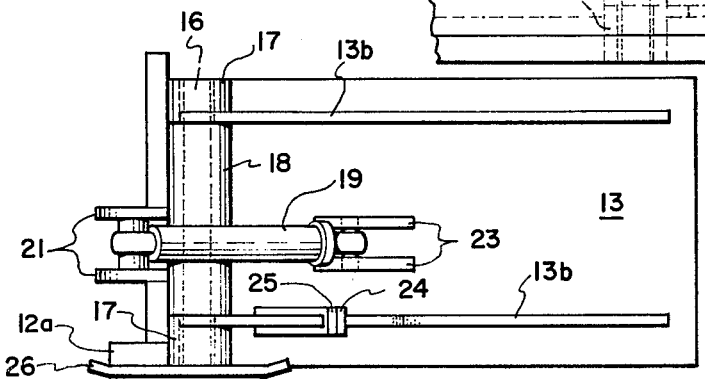
FIG. 5

MACHINE FOR AND METHOD OF STEMMING BLAST HOLES

BACKGROUND OF THE INVENTION

1. Field

The invention is in the field of blast hole stemming and of machines therefor.

2. State of the Art

It is presently common practice in open pit mining to break up material in the pit by a series of blasting operations, so that overburden can be removed and dumped as waste and ore can be removed and transported to a mill for processing. The blasting procedure normally involves drilling boreholes downwardly from substantially horizontal surfaces in the pit. The drill cuttings will pile up concentrically about such a borehole as it is drilled. An explosive charge is placed in the bottom of the resulting borehole, with a blasting cord extending therefrom up to the surface for detonating the charge. With the charge thus in place, the borehole is stemmed, i.e. is filled with the drill cuttings. Normally, this is accomplished manually by a crew of four or five men with hand shovels.

SUMMARY OF THE INVENTION

The invention provides for the mechanical stemming of blast holes by the proper manipulation of a special machine relative to earth material cuttings that collect concentrically about the mouth of the borehole during the drilling operation.

The machine is a vehicle having a combination of earth-moving blades mounted transversely across one of its ends. The vehicle itself is advantageously a conventional fork lift with forks replaced by the combination of earth-moving blades, which may be raised and lowered by relatively heavy-duty manipulating mechanism usually provided in substitution of the normal fork-lifting mechanism of the vehicle.

The blade combination comprises a fixed, main blade adapted to extend transversely across the vehicle as a pusher blade, and a pair of movable auxiliary blades pivotally mounted on the pusher blade in mutually spaced relationship transversely of the vehicle for swinging toward and away from each other as arms. The tip portions of the auxiliary blades are turned inwardly toward each other, so as to be in confronting relationship when the blades are swung together and so as to then act together on the earth material cuttings as a pull scraper. Preferably, the blades are curved toward each other along their outer end portions for this purpose.

Means for moving the auxiliary blades inwardly toward each other and outwardly away from each other are provided, and the arrangement is preferably such that the inward movement is limited to bringing the tip portions together sufficiently short of meeting that there is adequate clearance to accommodate the usual blasting cord, which extends out of the borehole and is advantageously tied to a stake at the far side of the borehole during the filling operation. The means for moving the auxiliary blades are preferably hydraulic power cylinders interposed between the main or pusher blade and the respective auxiliary blades, at the respective ends of the former and intermediate the lengths of the latter, so as to obtain effective operative leverage.

In carrying out the method, the machine is driven directly toward and to the hole, with auxiliary blades extended outwardly away from each other so the main or pusher blade will push drill cuttings into the hole from the front. The auxiliary blades are then moved together, so they will push drill cuttings into the hole from opposite sides. With these auxiliary blades together and the tip portions flanking the blasting cord, the machine is backed away from the hole so the tip portions of the auxiliary blades, acting in unison as a pull blade, pull drill cuttings into the hole from the rear.

THE DRAWINGS

An embodiment representing the best mode presently contemplated of carrying out the invention is illustrated in the accompanying drawings, in which:

FIG. 1 is a front elevation of the machine as incorporated in a rough terrain fork lift of standard type, with the auxiliary blades retracted in open position ready for the advance toward a borehole;

FIG. 2, a side elevation of the machine as shown in FIG. 1;

FIG. 3, a top plan view of the blade combination as shown in the preceeding figures, but detached from the vehicle, the view being drawn to a considerably larger scale and the retracted closed position of the auxiliary blades being indicated by broken lines;

FIG. 4, a fragmentary view in rear elevation as seen from the line 4–4 in FIG. 3; and FIG. 5, a view in side elevation as seen from the line 5—5 in FIG. 3.

DETAILED DESCRIPTION OF THE ILLUSTRATED EMBODIMENT

Referring to FIGS. 1 and 2, the machine of the invention is shown as including a standard, rough-terrain, fork-lift truck 10 provided with the usual mechanism (not shown in detail) for driving it forwardly and backwardly. The truck 10 has been modified by reducing the normal height of the masts 11; by substituting a combination of earth-moving blades, made up of a main pusher blade 12 and a pair of auxiliary blades 13; and by providing a pair of hydraulic, power cylinder and piston assemblies 14 as lifting means for the blade combination. The reduced mast height makes the vehicle less cumbersome, and the hydraulic power cylinders provide heavy-duty lifting power for raising and lowering the blade combination.

The pusher blade 12 is elongate and rectilinear as a base plate, backed by supporting and reinforcing structure **12*a*, for attachment transversely across the front end of the truck 10, e.g. by bolting to the usual fork lift frame 15, so it may be raised and lowered. The auxiliary blades 13 are pivotally attached at respective corresponding ends to the front face of pusher blade 12, in mutually spaced relationship, as by means of respective pivot pins 16 received by sets of collars 17 that are welded to such ends and similar elongate hinge members 18 that are welded to the front face of the pusher blade intermediate the ends thereof. The working portion 12b of pusher blade 12 is located between the pivoted ends of auxiliary blades 13**.

Hydraulic, power cylinder and piston assemblies 19 are pivotally attached at corresponding ends, respectively, to pusher blade 12, as by pins 20 in sets of upper and lower lugs 21, and are similarly attached to auxiliary blades 13, respectively, intermediate the lengths thereof, as by pins 22 in sets of lugs 23. These power cylinders function by suitable controls in the truck 10 to move the auxiliary blades inwardly toward each other from the open position shown in full lines in FIG. 3 to the closed position shown in broken lines, and vice versa. The tips 13*a* of the auxiliary blades are turned inwardly toward each other, preferably by curving the entire tip end portions of the blades inwardly as illustrated.

The auxiliary blades 13 are preferably reinforced by ribs 13*b* extending longitudinally thereof and are also preferably equipped at their lower margins with limit stop members 24 for abutment against corresponding limit stop members 25 projecting forwardly from the lower margin of pusher blade 12 respectively adjacent to the opposite ends thereof beyond the working portion 12*b*. These are arranged to stop outward swinging movement of auxiliary blades 12. Inward swinging movement is limited by the power cylinders 19 themselves. Skid shoes 26 are advantageously applied to the bottom edge of pusher blade 12 to prevent scraping into the solid ground surface below the loose earth material cuttings surrounding a borehole.

In carrying out the method of the invention, a blast hole (not illustrated) is stemmed following the placing of an explosive charge in the borehole that has been drilled from a substantially horizontal surface in the open-pit mine concerned, and that is still surrounded by the earth material cuttings from the drilling operation, by properly manipulating the illustrated machine of the invention previously described. To this end, it is preferable that the emergent portion of the usual blasting cord that extends up the borehole from the explosive charge be laid backwardly from the hole along the ground surface in back of the hole and be tied or otherwise secured to a stake driven into the ground a suitable distance behind the hole, so as not to be damaged by the pusher blade of the machine.

The machine is moved toward and to the borehole by driving the forklift truck 10 forwardly toward and to such borehole, with the blade combination lowered so the skid shoes 26 rest and slide upon the ground surface and with auxiliary blades 13 extended outwardly into the open position. In this way, working portion 12*b* of pusher blade 12 engages and pushes earth material cuttings into the hole from the front.

With the machine stopped at the front of the borehole, auxiliary blades 12 are swung inwardly to their closed position, thereby pushing earth material cuttings into the hole from the sides but stopping well short of engaging the blasting cord with the tips 13*a* of such blades.

Then, with the auxiliary blades 12 maintained in their closed position, the fork-lift truck 10 is driven backwardly so that the tip end portions 13*a* of the auxiliary blades pull earth material cuttings into the hole from the rear. During this backward movement of the machine, the emergent portion of the blasting cord is accommodated by the space 27 between the tips of the auxiliary blades.

Although the machine and method of the invention were developed primarily in connection with the stemming of blast holes in open-pit mining operations, there may well be analogous hole-filling situations to which the invention is applicable. For blast hole stemming in open-pit mining utilizing a standard fork-lift truck as the vehicle, it has been found advantageous to make the auxiliary blades about four feet long and two feet wide and to mount them on the pusher blade about eighteen inches apart. The limit stops are preferably positioned and arranged to place the tips of the auxiliary blades about six feet apart in the open position, and the hydraulic power cylinders for moving such blades inwardly are preferably constructed and arranged to stop them with their tips about one foot apart in the closed position of such blades.

Whereas this invention is here illustrated and described with respect to an embodiment thereof presently contemplated as the best mode of carrying it out in actual practice, it should be understood that various changes may be made without departing from the inventive concepts inherent in the disclosure.

I claim:

1. A machine for stemming blast holes, comprising a vehicle capable of being driven forwardly and backwardly; a substantially solely upstanding pusher blade extending transversely across the vehicle at an end thereof for pushing loose earth materials along a ground surface; a pair of auxiliary earthmoving blades pivotally mounted on said pusher blade in mutually spaced relationship transversely of the vehicle and swingable toward and away from each other, said auxiliary blades having tip portions inwardly turned so as to be in confronting relationship when the blades are swung together; and means for swinging the blades outwardly away from each other and inwardly toward each other.

2. A machine according to claim 1, wherein the vehicle is a forklift truck equipped with means for raising and lowering the pusher blade with its attached auxiliary blades.

3. A machine according to claim 1, wherein means are provided for stopping the inward swing of the auxiliary blades so their inwardly-turned tips will be spaced apart in confronting relationship.

4. A machine according to claim 3, wherein the means for swinging the auxiliary blades comprise respective hydraulic power cylinders and pistons mounted on and between the pusher blade and the respective auxiliary blades, and wherein said power cylinders and pistons provide the means for stopping the inward swing of said auxiliary blades.

5. A machine according to claim 1, wherein limit stops in the form of cooperative abutment stops are provided between the pusher blade and the respective auxiliary blades.

6. A method of stemming blast holes utilizing a machine constructed in accordance with claim 1, comprising the steps of moving the vehicle toward and to a borehole that is surrounded by earth material cuttings resulting from the drilling of the borehole, the blade end of the vehicle facing the hole with auxiliary blades extended outwardly away from each other in an open position and with the blades substantially resting on the ground surface, so as to push earth material cuttings into the hole from the front thereof; swinging the auxiliary blades inwardly toward each other to a closed position while maintaining the vehicle in position at the front of the borehole, so as to push earth material cuttings into the borehole from opposite sides thereof; and backing the vehicle away from the hole while maintaining the auxiliary blades in the previously assumed closed position, so as to pull earth cuttings into the borehole from the rear thereof.

7. A method according to claim 6, wherein the blasthole has therein an explosive charge from which a blasting cord extends to and along ground surface at and from the rear of the blasthole, and wherein the auxiliary blades are stopped short of meeting in the closed position thereof sufficiently to amply accommodate the blasting cord during the pulling of earth material cuttings into the borehole from the rear thereof.

* * * * *